US010107592B1

(12) United States Patent
Huang et al.

(10) Patent No.: US 10,107,592 B1
(45) Date of Patent: Oct. 23, 2018

(54) LASER TARGET POINTER

(71) Applicant: Quarton, Inc., New Taipei (TW)

(72) Inventors: Chao Chi Huang, New Taipei (TW); Liang Chiang Chen, New Taipei (TW)

(73) Assignee: Quarton, Inc. (TW)

( * ) Notice: Subject to any disclaimer, the term of this patent is extended or adjusted under 35 U.S.C. 154(b) by 0 days.

(21) Appl. No.: 15/951,076

(22) Filed: Apr. 11, 2018

(51) Int. Cl.
*F41G 11/00* (2006.01)
*F41G 1/35* (2006.01)

(52) U.S. Cl.
CPC ..... *F41G 1/35* (2013.01); *F41G 11/003* (2013.01)

(58) Field of Classification Search
CPC ..... F41G 1/35; F41G 11/001; F41G 11/003
USPC ..... 42/113, 114, 115
See application file for complete search history.

(56) References Cited

U.S. PATENT DOCUMENTS

2016/0010949 A1* 1/2016 Teetzel ..... F41G 1/35 42/115
2016/0102943 A1* 4/2016 Teetzel ..... F41G 1/35 42/113
2017/0038177 A1* 2/2017 Sun ..... F41G 1/30
2018/0087875 A1* 3/2018 Yost ..... F41G 11/003

* cited by examiner

*Primary Examiner* — J. Woodrow Eldred

(57) ABSTRACT

A laser target pointer for engaging a gun includes a body, a locating plate, a positioning block, a first fitting element and an adjustable positioning assembly. By providing the adjustable positioning assembly, the laser target pointer can be clamped to a gun with an arbitrary body width. By adjusting a position of the positioning block with respect to the locating plate, the laser target pointer can be positioned to a gun with an arbitrary transverse positioning groove. Thus, the laser target pointer can be properly assembled to any gun body having specifications within a predetermined range, and the position of the laser target pointer can be adjusted on the gun body in the extension direction, such that a single laser target pointer can be applicable to various guns with different brands, types, series or specifications.

10 Claims, 21 Drawing Sheets

LASER TARGET POINTER

This application claims the benefit of Taiwan Patent Application Ser. No. 106216997, filed Nov. 15, 2017, the subject matter of which is incorporated herein by reference.

BACKGROUND OF INVENTION

1. Field of the Invention

The invention relates to a laser target pointer, and more particularly to the laser target pointer that can be assembled onto a gun so as to provide an auxiliary aiming function to a gun shooting path of the gun.

2. Description of the Prior Art

Except as a weapon that accelerates a bullet by exploding gunpowders thereinside, the gun can be particularly structured for recreations and/or games (a paintball gun or an air gun, for example), and can be, but not limited to, pneumatically powered by a compressed air bottle. In order to raise shooting accuracy, gun manufacturers have developed versatile laser target pointers individually equipped onto a gun body of the gun for emitting a laser beam to demonstrate a corresponding shooting path and direction, such that an auxiliary aiming function can be provided. However, for different brands and types of the guns, the corresponding specifications thereof would be definitely different. Even to those guns that can use bullets of the same caliber, slight dimensional differences may exist among bodies of guns bearing different brands or series. Namely, to a laser target pointer designed specially for a gun with a specific specification, it is always the truth that this laser target pointer can't be assembled properly to another gun with similar specification. Therefore, while in designing or manufacturing a laser target pointer, it shall be necessary to provide various assembly structures at the same time for different guns with different brands, types, series or specifications to fit the same laser target pointer. Also, for a user having several guns with different but similar specifications of gun bodies, it is inevitable that a single laser target pointer can't be applicable to all of his/her guns. Thus, an improvement of the laser target pointer to overcome the aforesaid shortcoming is definitely necessary.

SUMMARY OF THE INVENTION

Accordingly, it is the primary object of the present invention to provide a laser target pointer for a gun, which includes an innovative and specific assembly structure that can properly fit any gun having a gun body with specifications fallen within a predetermined range. Further, by providing the assembly structure, the laser target pointer can be adjusted along the gun body in an extension direction. Thereupon, the laser target pointer of the present invention can be applicable to different guns with different brands, types, series or specifications.

In the present invention, the laser target pointer, to be engaged with a carrier having a guide rail structure extending in a first direction, includes:

a body, including thereon a laser module and a power module, having a top surface furnished with an accommodation base, a first engagement body and a second engagement body, wherein the first engagement body and the second engagement body are located individually to two opposing lateral sides of the accommodation base and extend in the first direction;

a locating plate, located in the accommodation base, integrated with the body as a unique piece, having thereon a fitting structure between the first engagement body and the second engagement body, the fitting structure extending in the first direction;

a positioning block, assembled to the fitting structure of the locating plate in a slidable manner so as to be confined and thus guided by the fitting structure to perform displacements in the first direction, so that a location of the positioning block on the locating plate in the first direction is adjustable;

a first fitting element, being to lock the positioning block onto the locating plate; wherein, after the positioning block on the fitting structure of the locating plate is displaced in the first direction to reach a predetermined position, the positioning block is positioned at the predetermined position on the locating plate by the first fitting element; wherein, when the positioning block is fixed on the locating plate, a top portion of the positioning block protrudes over the first engagement body and the second engagement body of the body; and an adjustable positioning assembly, including a first clamp block, a second clamp block and at least one second fitting element extending in a second direction perpendicular to the first direction, the first clamp block and the second clamp block being individually to mount onto the at least one second fitting element by sleeving, the at least one second fitting element being used to adjust spacing between the first clamp block and the second clamp block in the second direction;

wherein each of the first clamp block and the second clamp block includes a first gripping jaw and a second gripping jaw, the first gripping jaws of the first clamp block and the second clamp block are used to clamp the first engagement body and the second engagement body, respectively, the second gripping jaws of the first clamp block and the second clamp block are used to clamp the guide rail structure of the carrier, the at least one second fitting element is used to adjust the spacing between the first clamp block and the second clamp block in the second direction, and thereby the body is clamped through the adjustable positioning assembly to engage the guide rail structure of the carrier, such that no more displacement of the body with respect to the carrier in the second direction is allowed;

wherein, when the body is clamped through the adjustable positioning assembly to engage the guide rail structure of the carrier, the top portion of the positioning block is inserted into the guide rail structure of the carrier, so that no more displacement of the body with respect to the carrier in the first direction is allowed.

All these objects are achieved by the laser target pointer described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a laser target pointer. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
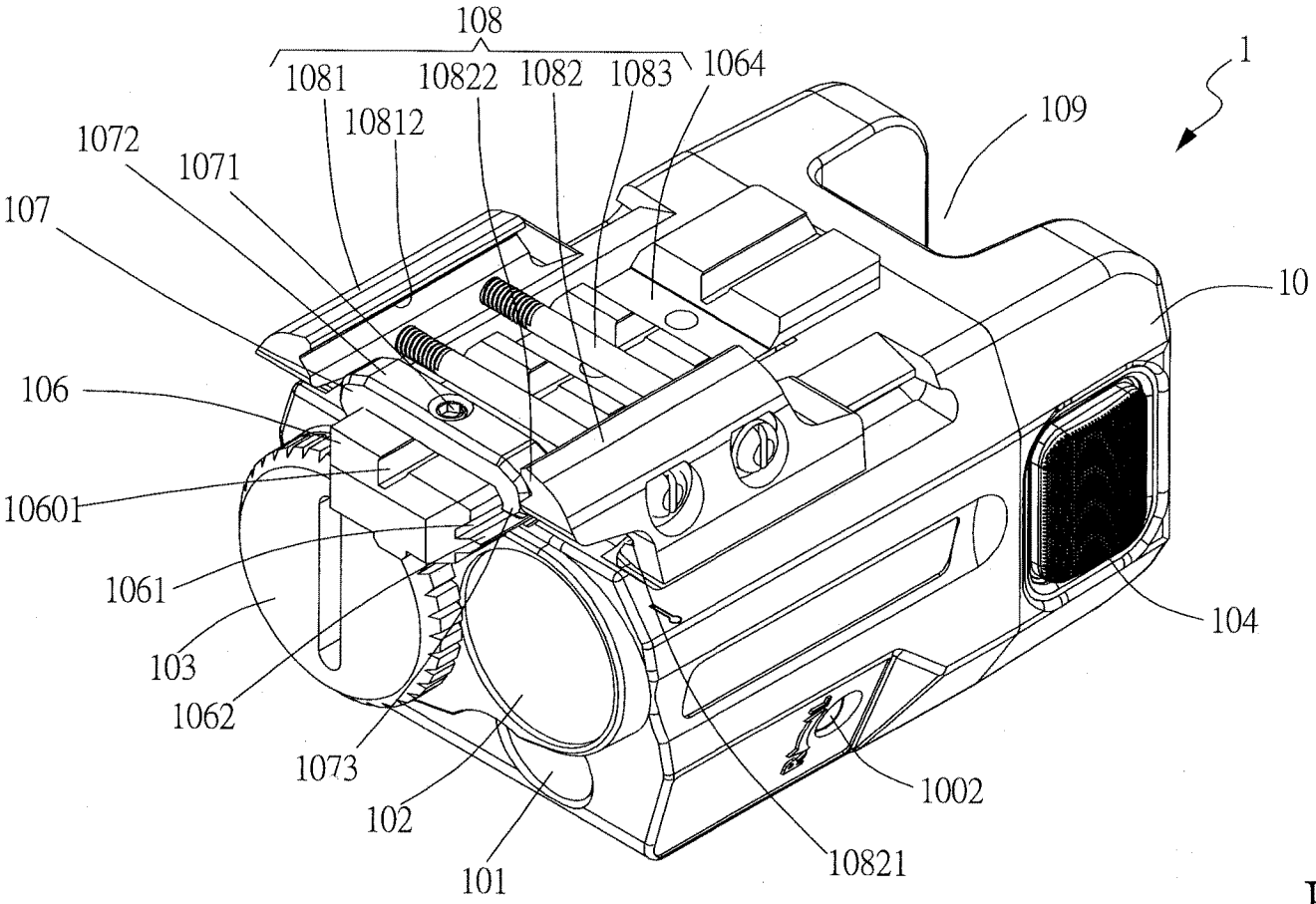
FIG. 1 is a schematic perspective view of a preferred embodiment of the laser target pointer in accordance with the present invention.
Figure 2:
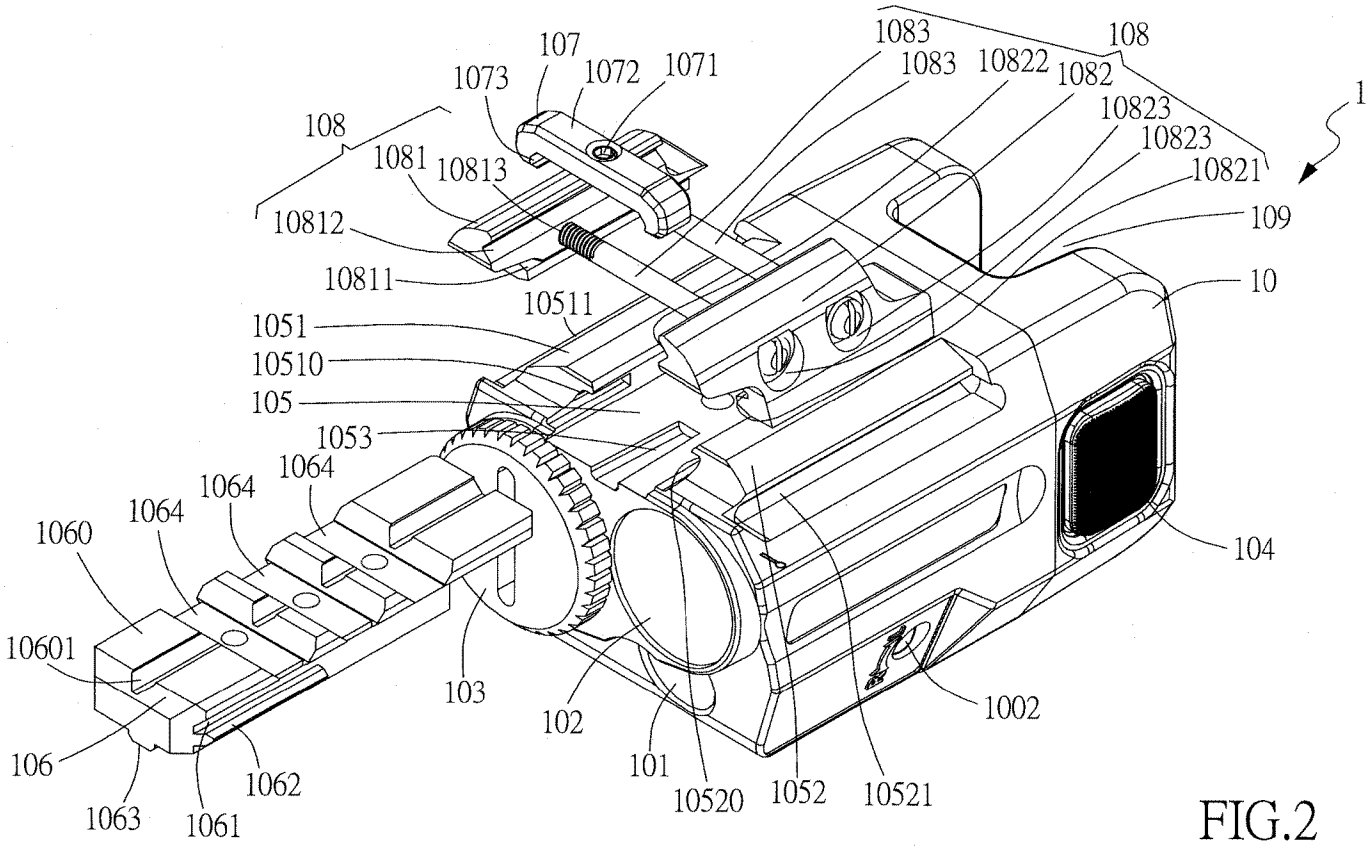
FIG. 2 is a largely exploded view of FIG. 1.
Figure 3A:
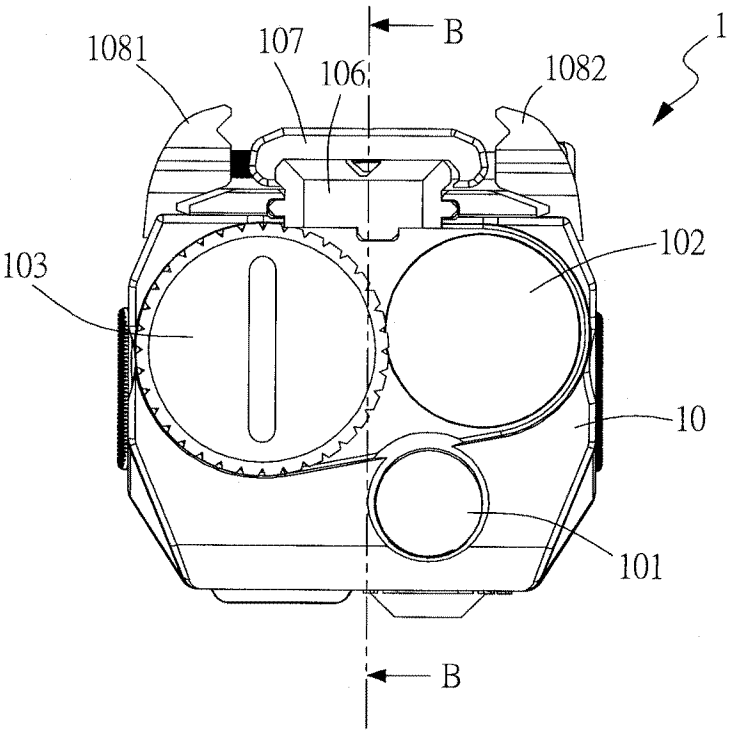
FIG. 3A to FIG. 3E demonstrate schematically a front view, a right-side view (symmetric to a left-sight view not shown herein), a rear view, a top view and a bottom view of the laser target pointer of FIG. 1, respectively.
Figure 3B:
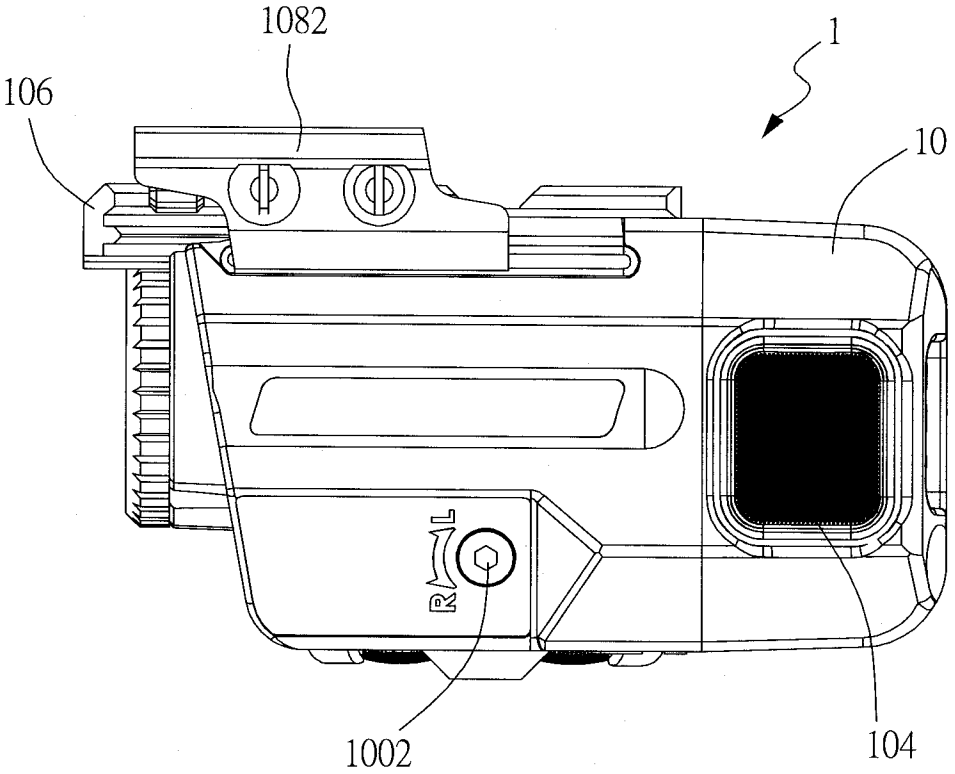
Figure 3C:
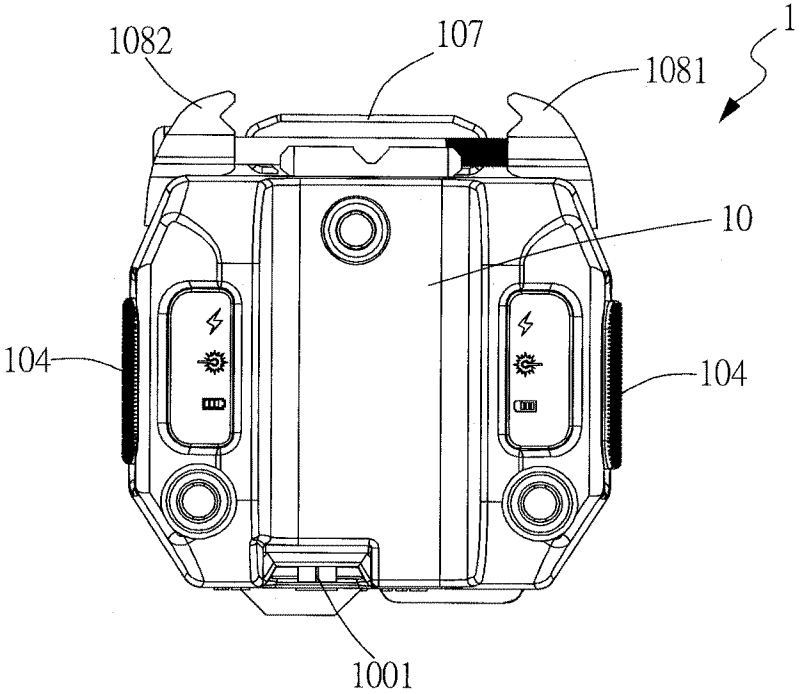
Figure 3D:
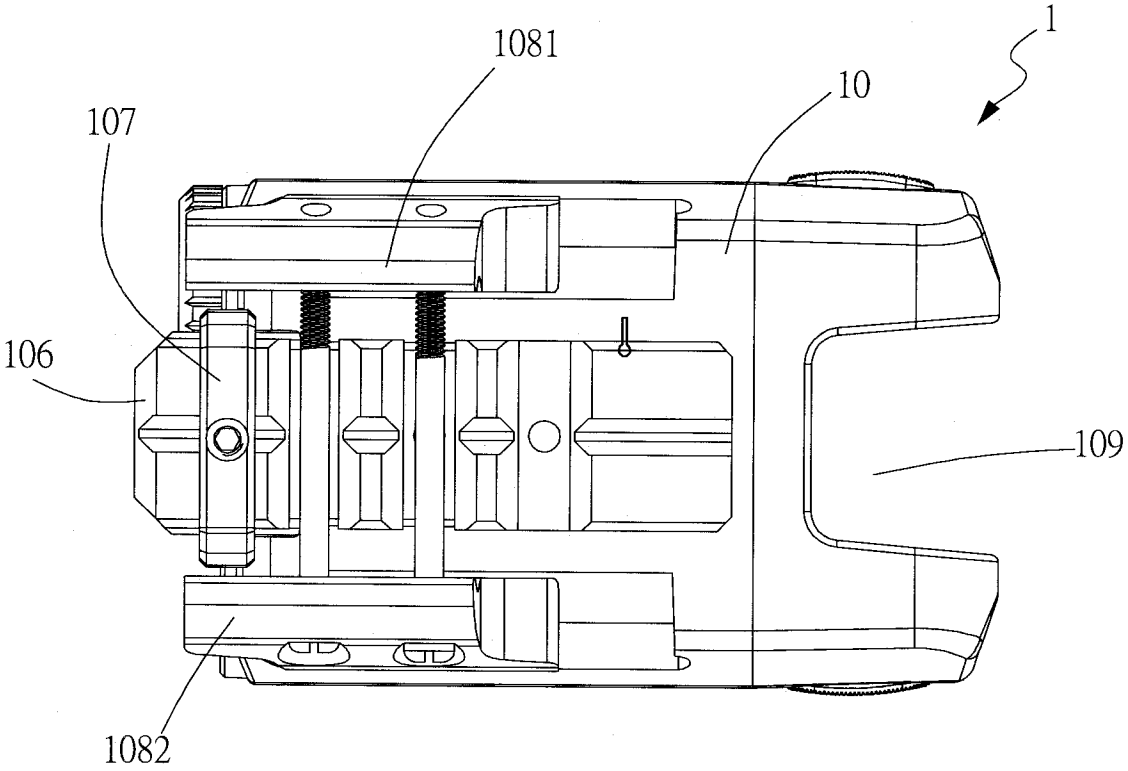
Figure 3E:
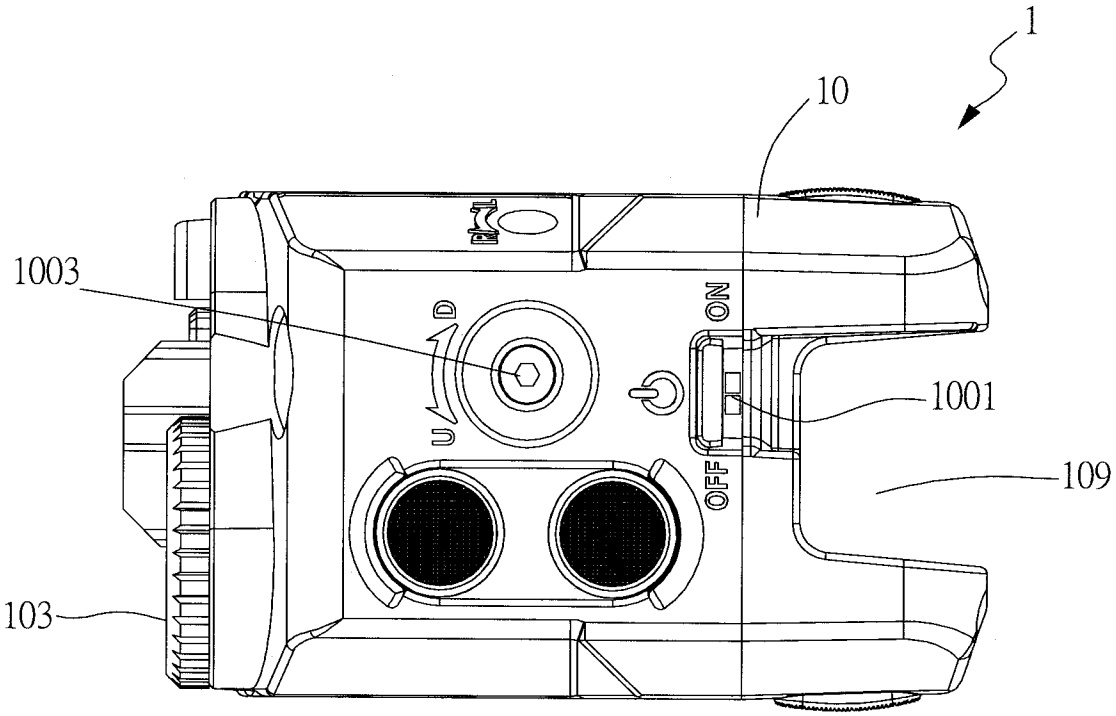
Figure 4:
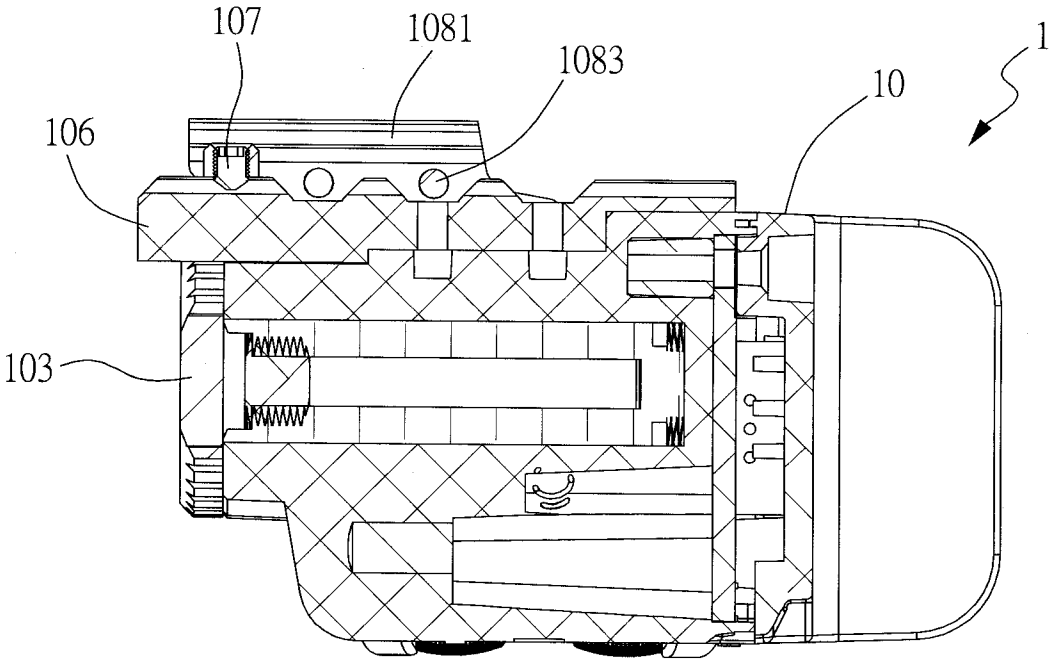
FIG. 4 is a schematic cross-sectional view of FIG. 3A along line B-B.

Refer to FIG. 1 through FIG. 4; where FIG. 1 is a schematic perspective view of a preferred embodiment of the laser target pointer in accordance with the present invention, FIG. 2 is a largely exploded view of FIG. 1, FIG. 3A to FIG. 3E demonstrate schematically a front view, a right-side view (symmetric to a left-sight view not shown herein), a rear view, a top view and a bottom view of the laser target pointer of FIG. 1, respectively, and FIG. 4 is a schematic cross-sectional view of FIG. 3A along line B-B. Also, refer to FIG. 5 through FIG. 6B; where FIG. 5 is a schematic perspective view of the laser target pointer of FIG. 1 and a gun (assembled together), and FIG. 6A and FIG. 6B show schematically a front view and a cross-sectional view along line C-C of FIG. 5, respectively.

Figure 5:
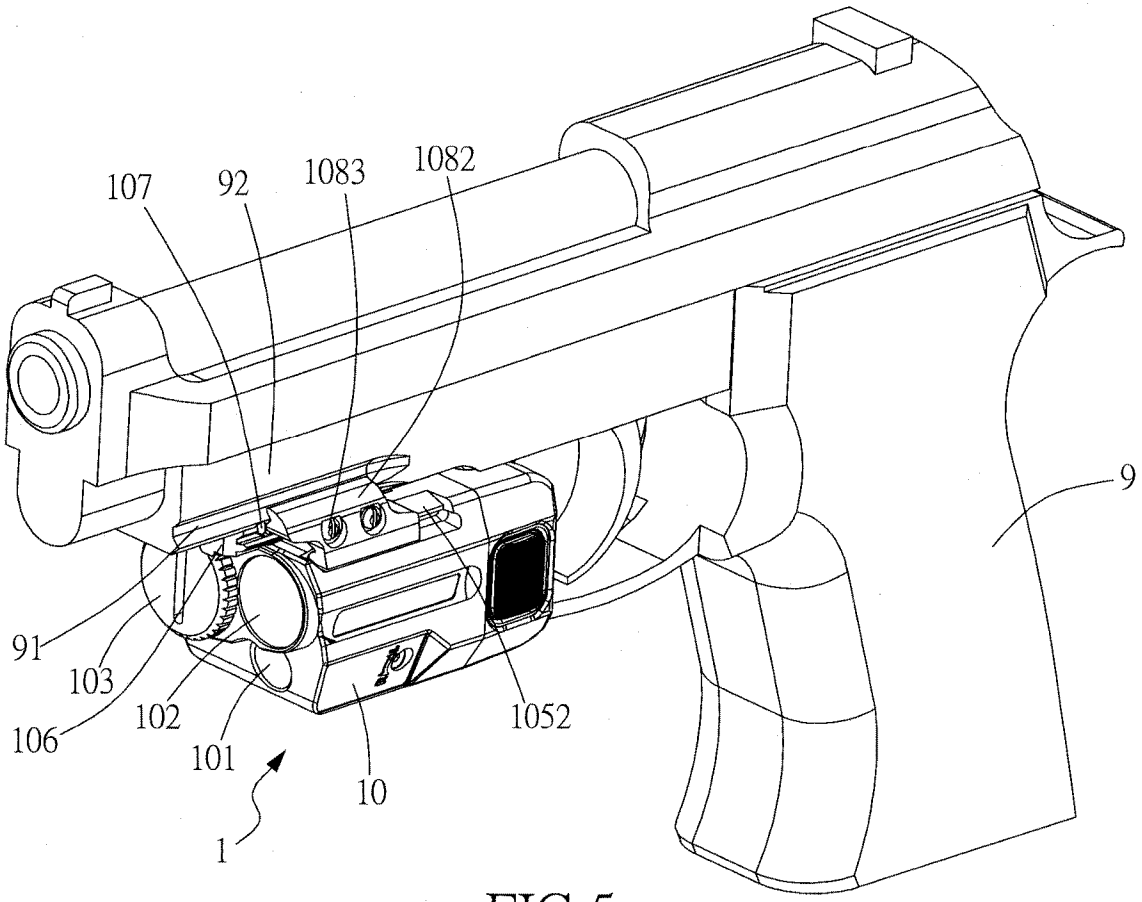
FIG. 5 is a schematic perspective view of the laser target pointer of FIG. 1 and a gun, assembled together.
Figure 6A:
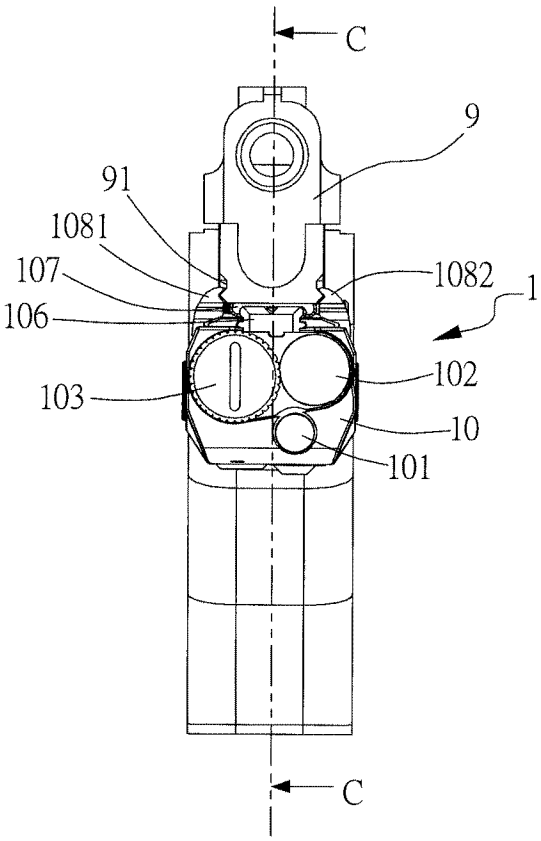
FIG. 6A and FIG. 6B show schematically a front view and a cross-sectional view along line C-C of FIG. 5, respectively.
Figure 6B:
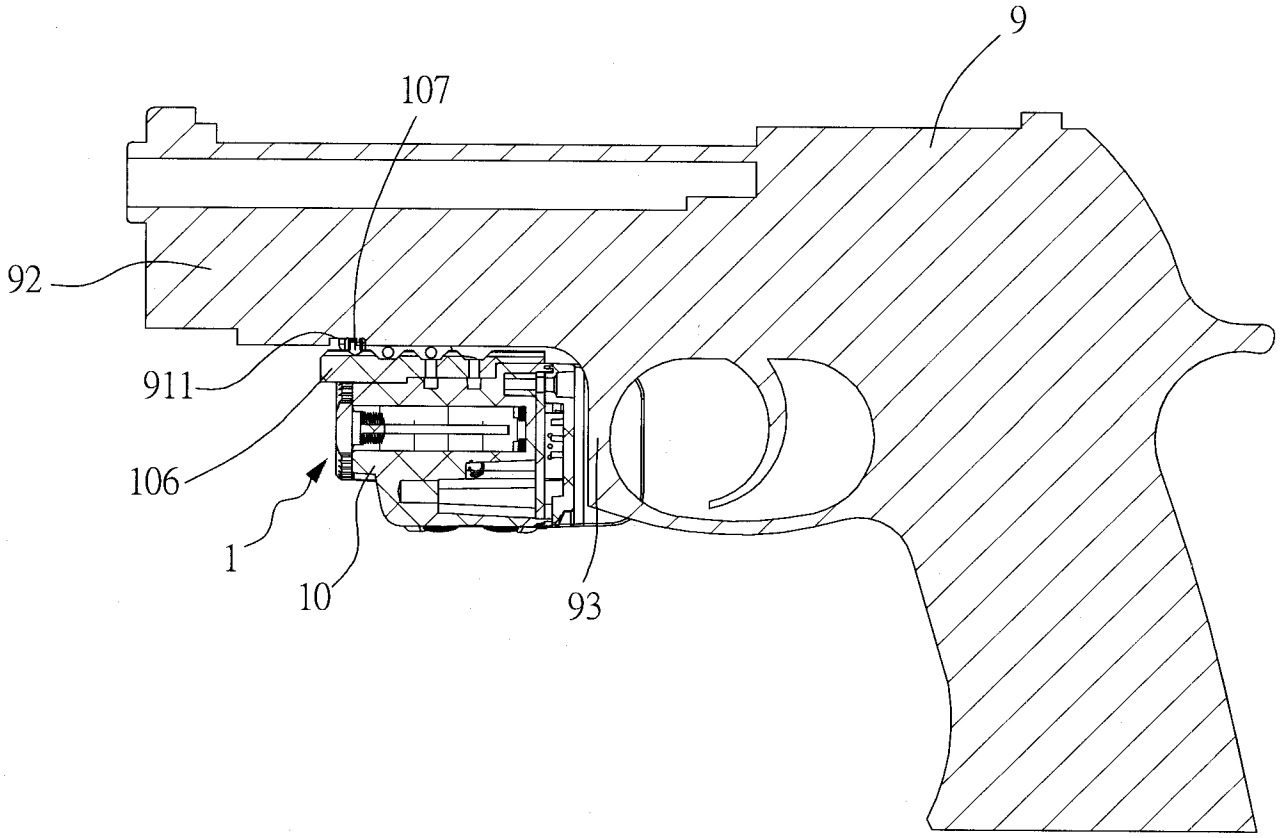

As shown in FIG. 5, FIG. 6A and FIG. 6B, the laser target pointer 1 of the present invention is to engage a carrier 9. The carrier 9 has thereon a guide rail structure 91 extending in a first direction. In this embodiment, the carrier 9 is, but not limited to, a gun such like a pistol. The first direction, largely parallel to a flight direction of the bullet fired by the gun, is an extension direction of a gun body 92 or a barrel of the gun (i.e., the carrier 9). As shown in FIG. 1, FIG. 2, FIGS. 3A to 3E, and FIG. 4, the laser target pointer 1 includes a body 10, a locating plate 106, a positioning block 107, a first fitting element 1071, and an adjustable positioning assembly 108.

In the body 10, all necessary optical and electronic elements required for performing the laser targeting or aiming functions (including a function of emitting a laser beam) are included. In this embodiment, the body 10 includes thereon a laser module 101, a light-source module 102, a power module 103, at least one slip proof structure 104, a switch module 1001 and at least two adjusting members 1002, 1003. The power module 103 includes a removable twist-offcap (not labeled in the figure) located on a front-end surface of the body 10, and a battery (not shown in the figure) mounted into the body 10 while the twist-off cap is removed. The laser module 101, electrically coupled with the power module 103, can be energized by electric energy provided by the power module 103, and is located on the front-end surface of the body 10 to emit a laser beam for demonstrating the shooting path and direction of the gun (i.e., the carrier 9), such that the auxiliary aiming function of the laser target pointer 1 can be provided. The light-source module 102, electrically coupled with the power module 103, includes at least one LED component, and can be energized by the electric energy provided by the power module 103 to emit a lighting source from the front-end surface of the body 10.

On a top surface of the body 10, an accommodation base 105 and two engagement bodies 1051, 1052 (a first engagement body 1051 and a second engagement body 1052) are furnished. The first engagement body 1051 and the second engagement body 1052 are individually located laterally to the accommodation base 105 and extending longitudinally in the first direction. Further, two slip proof structures 104 for user's fingers to touch thereon are furnished respectively to two end surfaces of the body 10, where these two end surfaces are in a second direction perpendicular to the first direction. In this embodiment, each of the slip proof structures 104 is finished with a surface having a plurality of micro concave and/or convex structures formed by rubber, silicon or any soft material the like, such that frictions and holding comfort with the finger tips at the slip proof structures 104 can be raised. The switch module 1001, having a switch (not labeled in the figure) on a bottom surface of the body 10, is electrically coupled with the laser module 101, the light-source module 102 and the power module 103, so as to control the energy supply of the power module 103 to the laser module 101 and the light-source module 102. The at least two adjusting members 1002, 1003, located respectively to a right-side surface (or a left-side surface alternatively) and the bottom surface of the body 10, can be rotated or twisted to adjust a light-emitting angle and/or a focus of the laser beam emitted by the laser module 101, such that the aiming accuracy can be raised by calibrating the laser beam to the flight path of the bullet of the gun.

The locating plate 106 is located inside the accommodation base 105, and integrated with the body 10 into a unique piece. On the locating plate 106, a fitting structure 1061 is located between the first engagement body 1051 and the second engagement body 1052, and extends longitudinally in the first direction. In this embodiment, a bottom groove 1053 and two lateral grooves 10510, 10520 are extended on the accommodation base 105 in the first direction, in which the two lateral grooves 10510, 10520 are largely located at the first engagement body 1051 and the second engagement body 1052, respectively, by facing the accommodation base 105 in a longitudinal wise. The locating plate 106 has thereon a bottom rib 1063 and two lateral ribs 1062 located at respective places corresponding to the bottom groove 1053 and the two lateral grooves 10510, 10520, respectively. By engaging (inserting, in this embodiment) the bottom rib 1063 and the two lateral ribs 1062 of the locating plate 106 with the corresponding bottom groove 1053 and the two corresponding lateral grooves 10510, 10520, the locating plate 106 can then be positioned on the accommodation base 105 of the body 10. Then, the locating plate 106 can be fixed on the body 10 via screwing, gluing, soldering or the like. In another embodiment of the present invention not shown here, the locating plate 106 can be directly formed on the top surface of the body as a unique piece.

The positioning block 107 can be assembled to the fitting structure 1061 of the locating plate 106 in a slidable manner. Thereupon, the positioning block 107 can be then confined and thus guided by the fitting structure 1061 to perform displacements in the first direction, so that the location of the positioning block 107 on the locating plate 106 in the first direction can be adjusted. The first fitting element 1071 is used to lock the positioning block 107 onto the locating plate 106. After the positioning block 107 on the fitting structure 1061 of the locating plate 106 is displaced in the first direction to reach a predetermined position, the positioning block 107 can be positioned at the predetermined position on the locating plate 106 by the first fitting element 1071. Also, when the positioning block 107 is fixed on the locating plate 106, a top portion 1072 of the positioning block 107 would protrude over the first engagement body 1051 and the second engagement body 1052 of the body 10. In this embodiment, the two opposing fitting structures 1061 are individually constructed to two opposing lateral sides of the locating plate 106, and formed as narrow grooves extending in the first direction. In the second direction, the positioning block 107 has two opposing ends individually bent downward to form respective hook structures 1073 for hooking the corresponding fitting structures 1061 (the narrow grooves) at the two opposing lateral sides of the locating plate 106, such that the positioning block 107 can be guided by, thus slide along, the fitting structures 1061 of the locating plate 106 to the predetermined position in the first direction.

The adjustable positioning assembly 108 includes a first clamp block 1081, a second clamp block 1082, and at least one second fitting element 1083 extending longitudinally in the second direction. The first clamp block 1081 and the second clamp block 1082 are individually to mount onto opposing ends of the at least one second fitting element 1083 by sleeving, and form substantially parallel to each other by adjustable spacing. Namely, in the second direction, the spacing between the first clamp block 1081 and the second clamp block 1082 can be changed by adjusting the at least one second fitting element 1083. In this embodiment, each of the first clamp block 1081 and the second clamp block 1082 includes a first gripping jaw (10811 and 10821), a second gripping jaw (10812 and 10822) and at least one bolt hole (10813 and 10823). The first gripping jaws 10811, 10821 of the first clamp block 1081 and the second clamp block 1082, respectively, are used to clamp corresponding lateral recesses 10511, 10521 exterior to the first engagement body 1051 and the second engagement body 1052, respectively. In addition, the second gripping jaws 10812, 10822 of the first clamp block 1081 and the second clamp block 1082 are used together to clamp the guide rail structure 91 of the carrier 9. The at least one second fitting element 1083 is used to adjust the spacing between the first clamp block 1081 and the second clamp block 1082 in the second direction, and thereby the body 10 can be clamped through the adjustable positioning assembly 108 to engage the guide rail structure 91 of the carrier 9, such that no more displacement of the body with respect to the carrier 9 in the second direction can be possible, as shown in FIG. 5. Under this circumstance, even in the case that a width of the guide rail structure 91 of the carrier 9 is slightly biased, proper clamping can be still achieved through adjusting the spacing of the first clamp block 1081 and the second clamp block 1082 in the second direction. In other words, the adjustable positioning assembly 108 provided by the present invention can clamp the body 10 onto a gun carrier 9 with an arbitrary width. In this embodiment, the second fitting element 1083, structured to be a screw bolt, is to connect spatially the first clamp block 1081 and the second clamp block 1082 by penetrating corresponding bolt holes 10813, 10823 thereof, respectively. As shown in FIG. 6B, when the body 10 is clamped, by the adjustable positioning assembly 108, to engage the guide rail structure 91 of the carrier 9, the top portion 1072 of the positioning block 107 would be inserted into a transverse positioning groove 911 of the guide rail structure 91 of the carrier 9, such that no movement of the body 10 in the first direction with respect to the carrier 9 can be performed. In addition, a tail end of the body 10 in the first direction has a rear concavity 109. When the body 10 is clamped to engage the guide rail structure 91 of the carrier 9 through the adjustable positioning assembly 108, a trigger guard 93 of the gun (carrier 9) would be right fitted into the rear concavity 109.

As shown in FIG. 1. FIG. 2 and FIG. 4, in this embodiment, a V-shape groove 10601 extending in the first direction is constructed on an upper surface 1060 of the locating plate 106. Also, on an upper surface 1060 of the locating plate 106, at least one top groove 1064 is constructed by extending in the second direction. The first fitting element 1071, formed as a screw, is firstly screwed through a screw hole of the positioning block 107, and then penetrates further to have a lower end thereof to contact at both slant sidewalls of the V-shape groove 10601. In this state, since both hook structures 1073 formed as opposing ends of the positioning block 107 are individually connected with the corresponding fitting structures 1061 of the locating plate 106 by hooking, so the positioning block 107 can be locked to the locating plate 106. In addition, when the first gripping jaws 10811, 10821 of the first clamp block 1081 and the second clamp block 1082 of the adjustable positioning assembly 108 are clamped with the corresponding first engagement body 1051 and second engagement body 1052 of the body 10, the at least one second fitting element 1083 is located in the at least one top groove 1064 of the locating plate 106.

While in describing a following embodiment of the present invention, since most of the elements or structures thereof are resembled or similar at least to those of the aforesaid embodiment, thus elements or structures of the following embodiment that are resembled to those of the aforesaid embodiment would be assigned directly and correspondingly by the same names and labels, and details thereabout would be omitted herein. On the other hand, elements or structures of the following embodiment that are similar to those of the aforesaid embodiment would be assigned correspondingly by the same names but by labels consisted of the original labels with a tailing letter, and details thereabout would be omitted herein as well.

Figure 7:
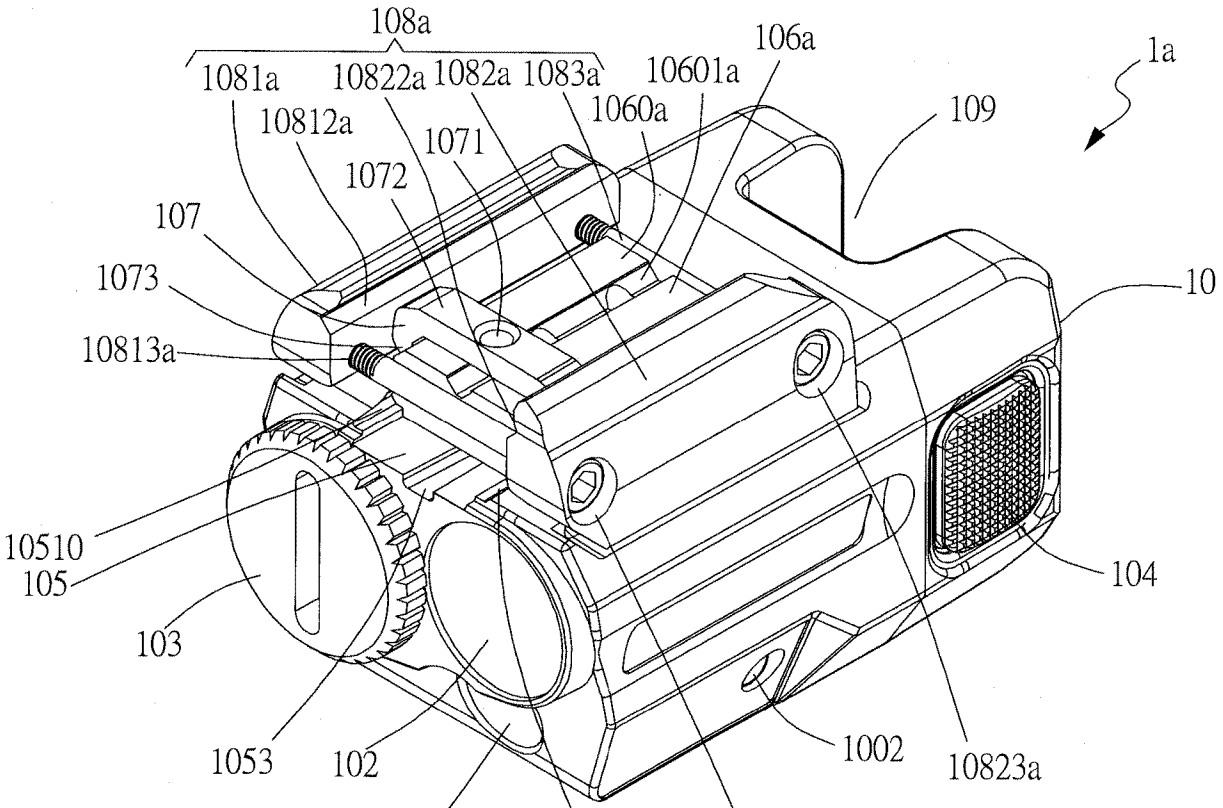
FIG. 7 is a schematic perspective view of another embodiment of the laser target pointer in accordance with the present invention.
Figure 8:
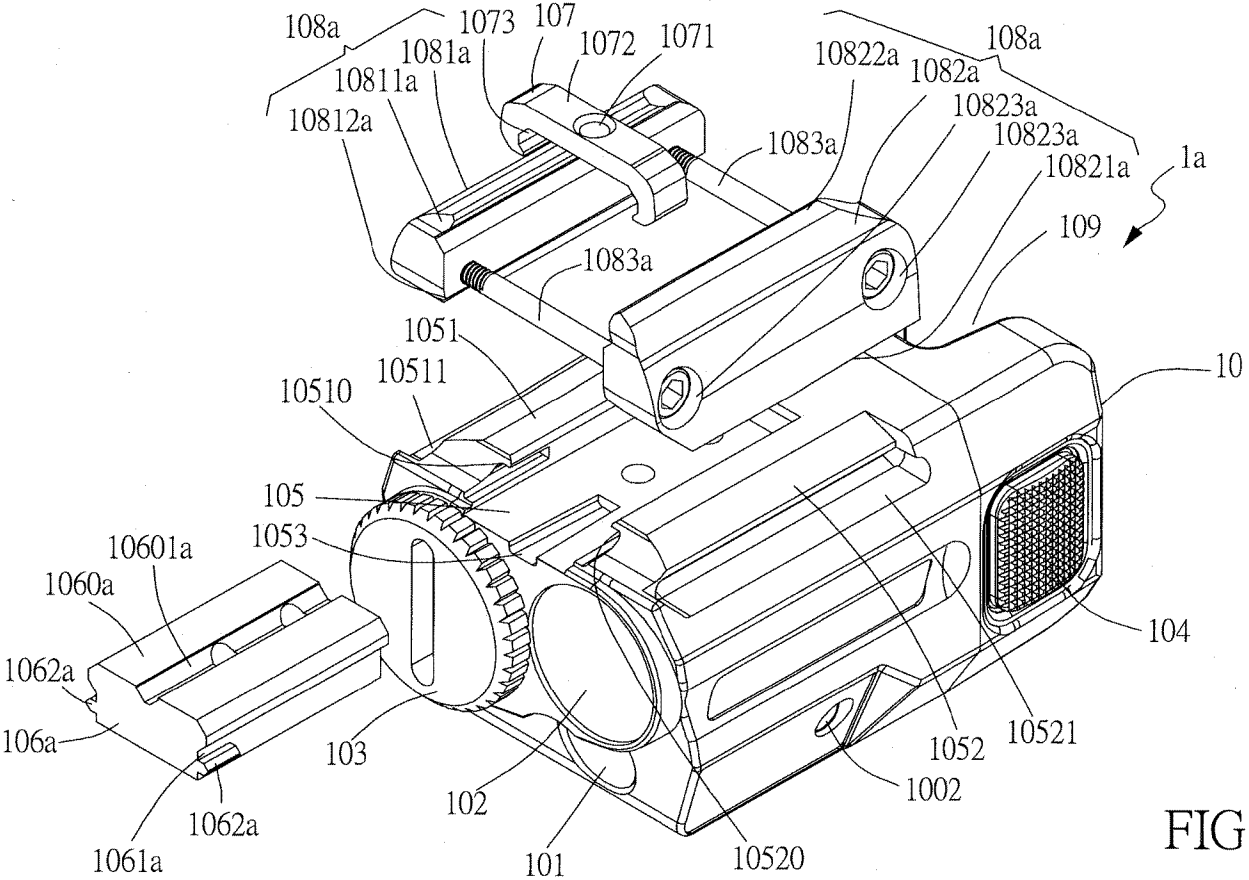
FIG. 8 is a largely exploded view of FIG. 7.
Figure 9A:
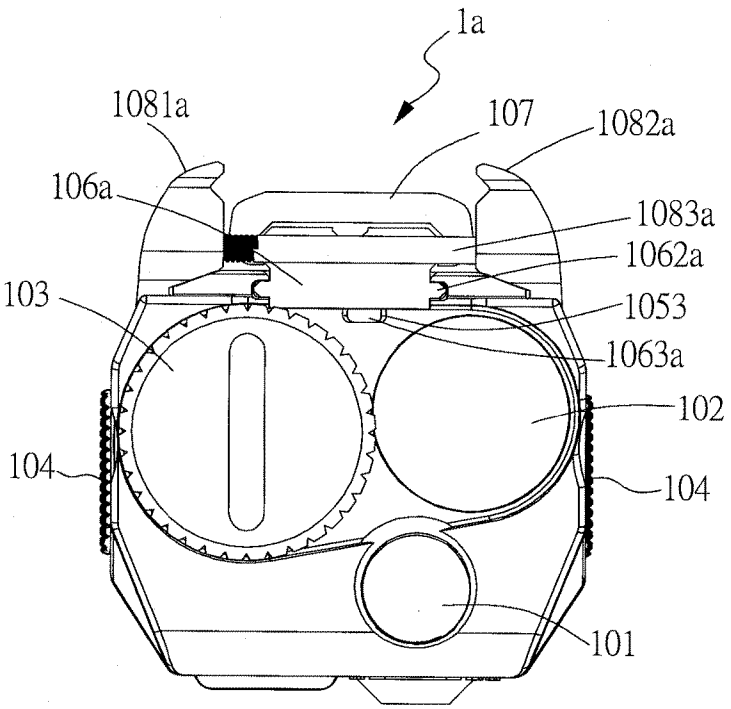
FIG. 9A to FIG. 9E demonstrate schematically a front view, a right-side view (symmetric to a left-sight view not shown herein), a rear view, a top view and a bottom view of the laser target pointer of FIG. 7, respectively.
Figure 9B:
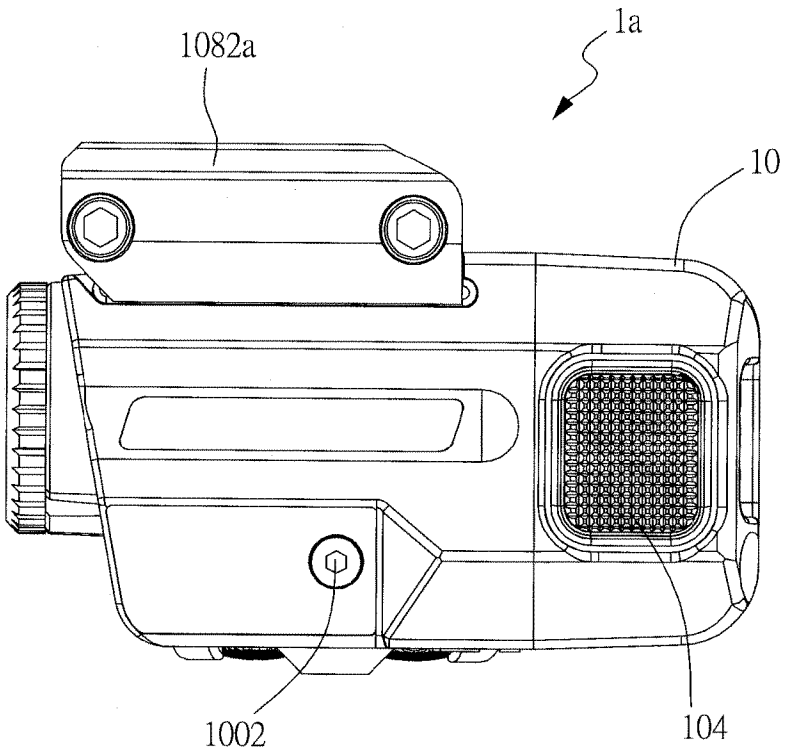
Figure 9C:
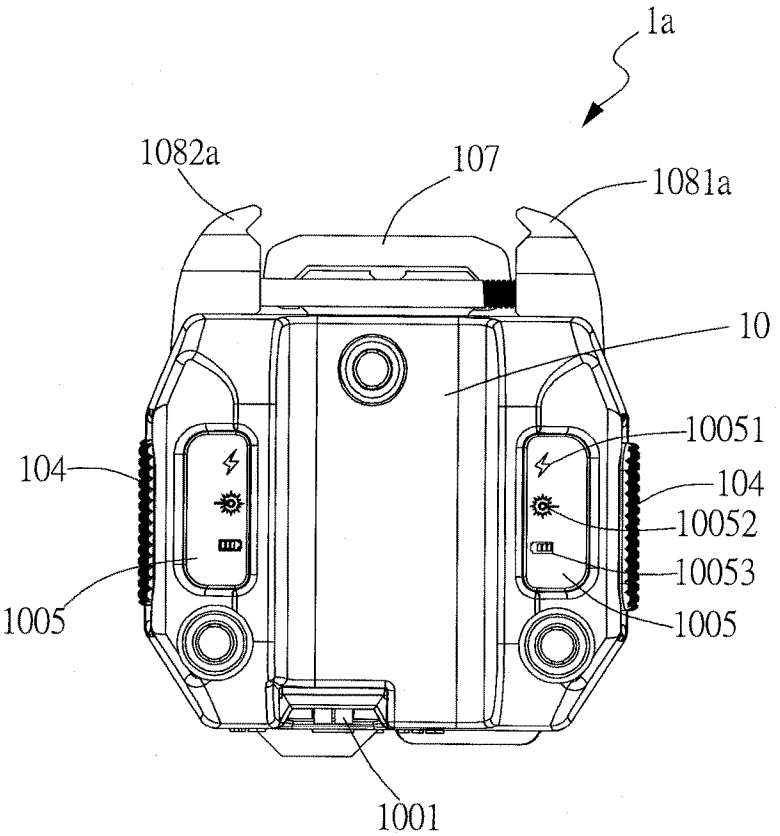
Figure 9D:
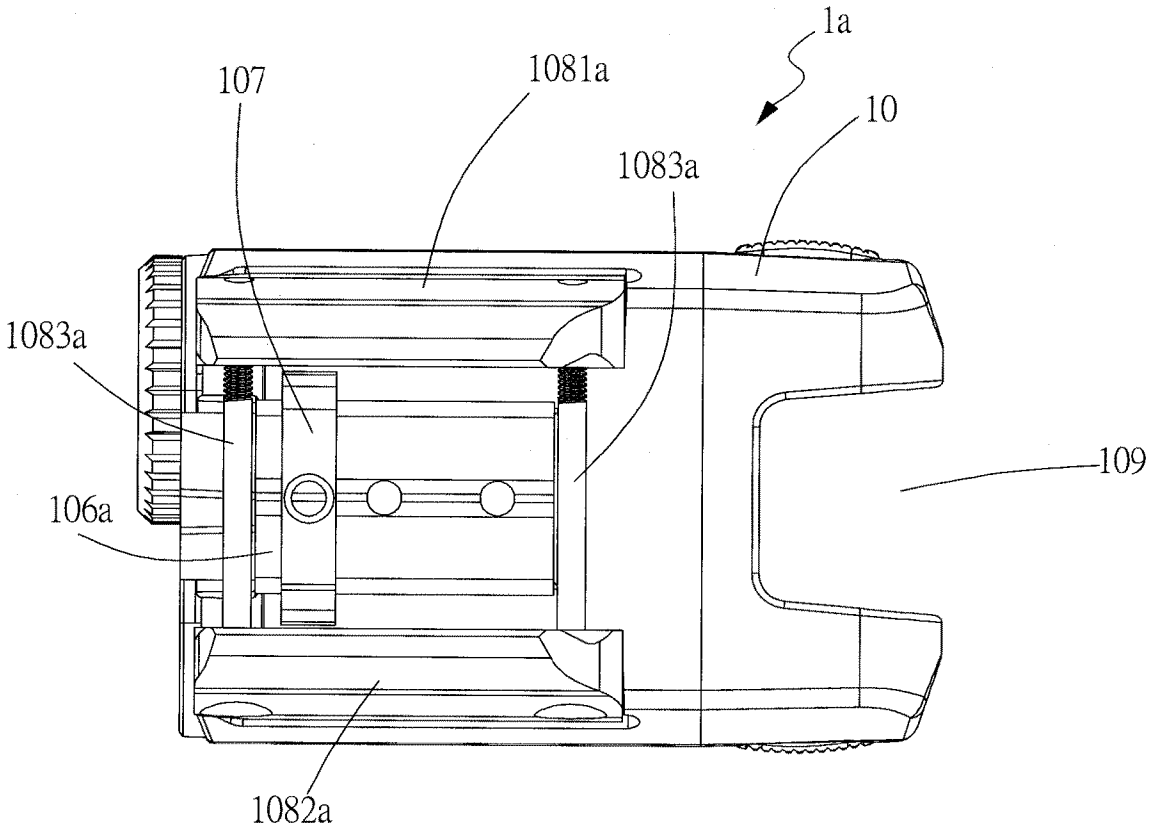
Figure 9E:
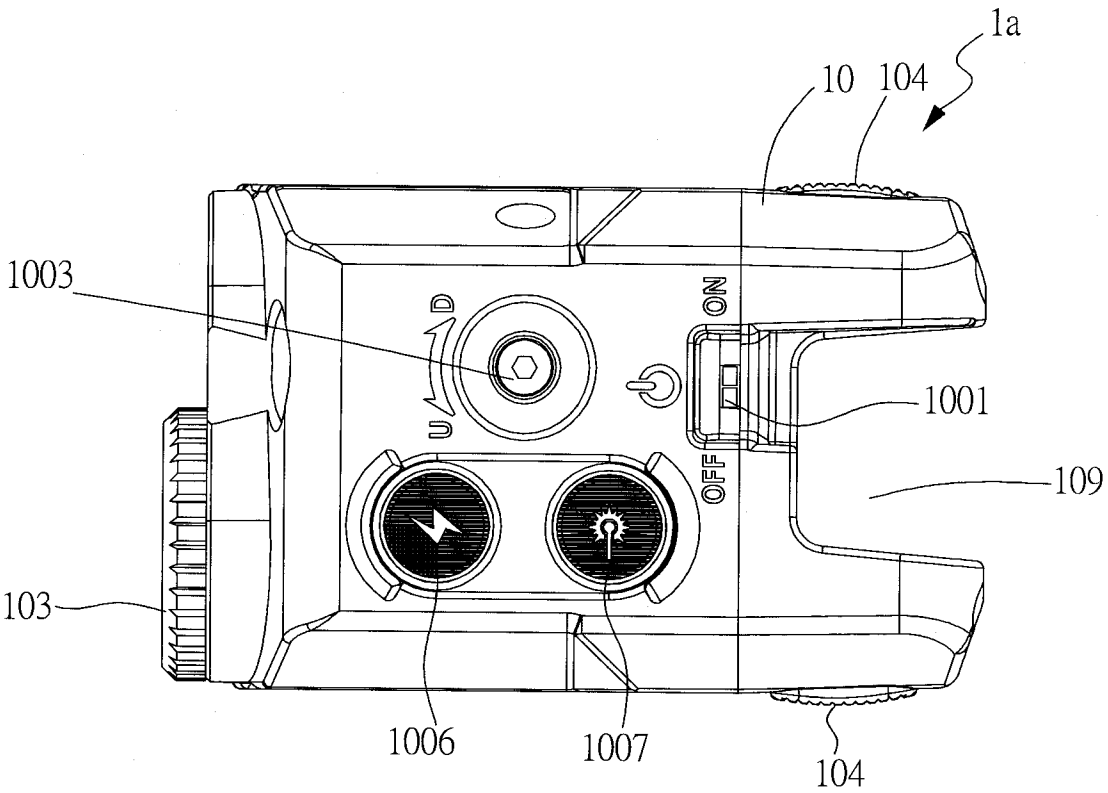
Figure 10:
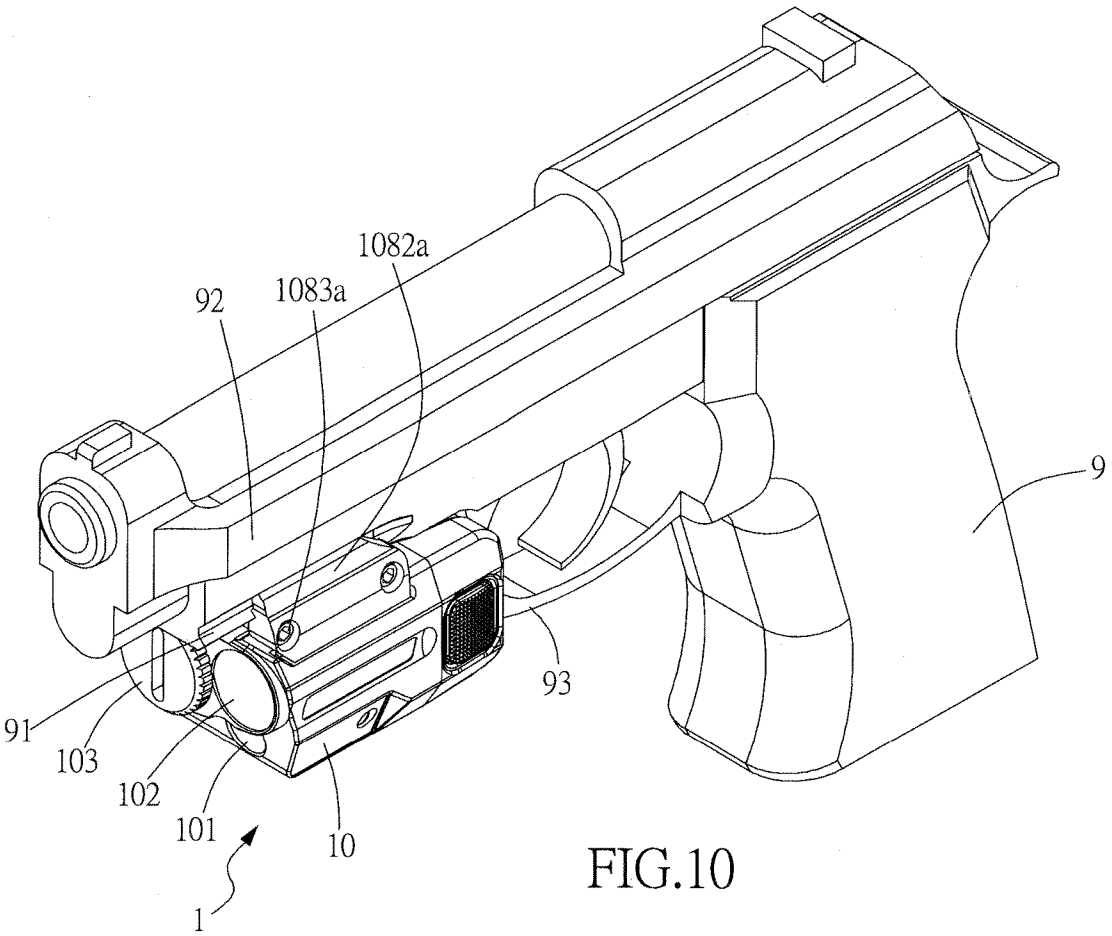
FIG. 10 is a schematic perspective view of the laser target pointer of FIG. 7 and a gun, assembled together.
Figure 11A:
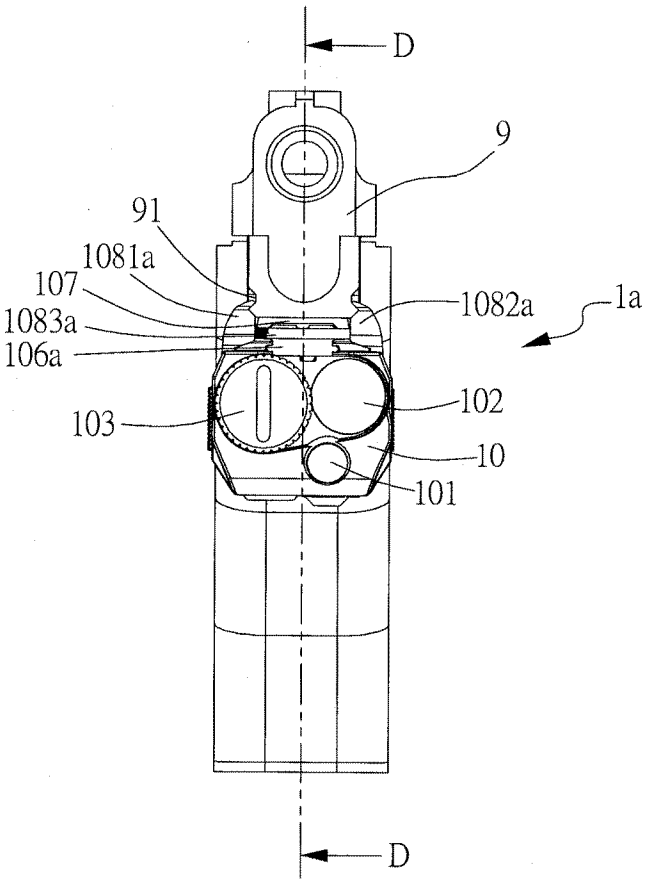
FIG. 11A and FIG. 11B show schematically a front view and a cross-sectional view along line D-D of FIG. 10, respectively.
Figure 11B:
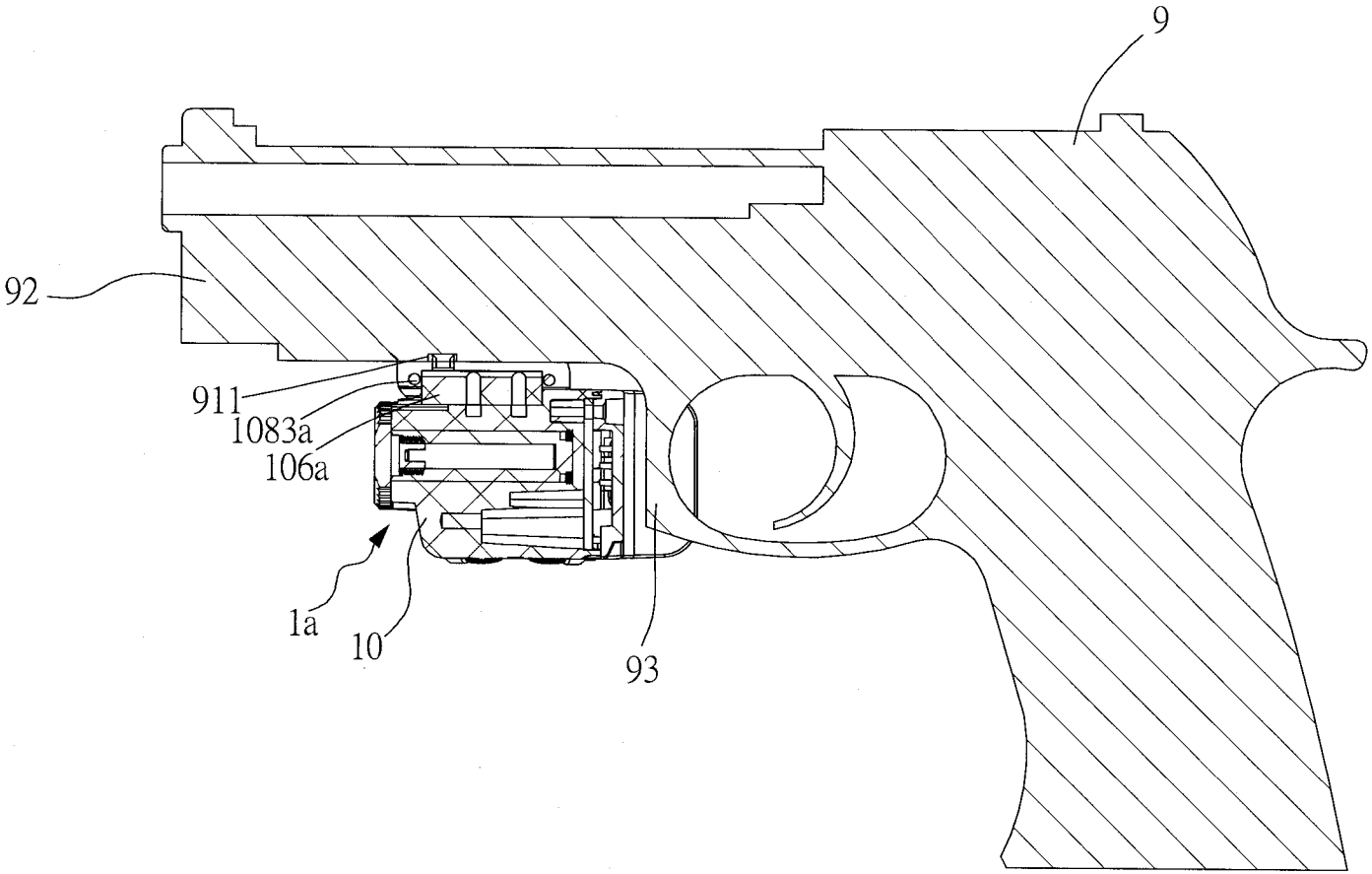

Refer to FIG. 7 through FIG. 10; where FIG. 7 is a schematic perspective view of another embodiment of the laser target pointer in accordance with the present invention. FIG. 8 is a largely exploded view of FIG. 7, and FIG. 9A to FIG. 9E demonstrate schematically a front view, a right-side view (symmetric to a left-sight view not shown herein), a rear view, a top view and a bottom view of the laser target pointer of FIG. 7, respectively. Also, refer to FIG. 10 through FIG. 11B; where FIG. 10 is a schematic perspective view of the laser target pointer of FIG. 7 and a gun (assembled together), and FIG. 11A and FIG. 11B show schematically a front view and a cross-sectional view along line D-D of FIG. 10, respectively.

In this embodiment, the laser target pointer 1*a* of the present invention is to engage a carrier 9. The carrier 9 has thereon a guide rail structure 91 extending longitudinally in a first direction. In this embodiment, the carrier 9 is, but not limited to, a gun. The first direction, largely parallel to a flight direction of the bullet fired by the gun, is an extension direction of a gun body 92 or a barrel of the gun (i.e., the carrier 9).

The laser target pointer 1*a* includes a body 10, a locating plate 106*a*, a positioning block 107, a first fitting element 1071, and an adjustable positioning assembly 108*a*. The body 10 includes thereon a laser module 101, a light-source module 102, a power module 103, at least one slip proof structure 104, a switch module 1001 and at least two adjusting members 1002, 1003. The power module 103 includes a removable twist-off cap (not labeled in the figure) located on a front-end surface of the body 10, and a battery (not shown in the figure) mounted into the body 10 while the twist-off cap is removed. The laser module 101, electrically coupled with the power module 103, can be energized by electric energy provided by the power module 103, and is located on the front-end surface of the body 10 to emit a laser beam for demonstrating the shooting path and direction of the gun (i.e., the carrier 9), such that the auxiliary aiming function of the laser target pointer 1*a* can be provided. The light-source module 102, electrically coupled with the power module 103, includes at least one LED component, and can be energized by the electric energy provided by the power module 103 to emit a lighting source from the front-end surface of the body 10.

On a top surface of the body 10, an accommodation base 105 and two engagement bodies 1051, 1052 (a first engagement body 1051 and a second engagement body 1052) are furnished. The first engagement body 1051 and the second engagement body 1052 are individually located laterally to the accommodation base 105 and extending longitudinally in the first direction. Further, two slip proof structures 104 for user's fingers to touch thereon are furnished respectively to two end surfaces of the body 10, where these two end surfaces are in a second direction perpendicular to the first direction. In this embodiment, each of the slip proof structures 104 is finished with a surface having a plurality of micro concave and/or convex structures formed by rubber, silicon or any soft material the like, such that frictions and holding comfort with the finger tips at the slip proof structures 104 can be raised. The switch module 1001, having a switch (not labeled in the figure) on a bottom surface of the body 10, is electrically coupled with the laser module 101, the light-source module 102 and the power module 103, so as to control the energy supply of the power module 103 to the laser module 101 and the light-source module 102. The at least two adjusting members 1002, 1003, located respectively to a right-side surface (or a left-side surface alternatively) and the bottom surface of the body 10, can be rotated or twisted to adjust a light-emitting angle and/or a focus of the laser beam emitted by the laser module 101, such that the aiming accuracy can be raised by calibrating the laser beam to the flight path of the bullet of the gun.

The locating plate 106*a* is located inside the accommodation base 105, and integrated with the body 10 into a unique piece. On the locating plate 106*a*, a fitting structure 1061*a* is located between the first engagement body 1051 and the second engagement body 1052, and extends longitudinally in the first direction. In this embodiment, a bottom groove 1053 and two lateral grooves 10510, 10520 are extended on the accommodation base 105 in the first direction, in which the two lateral grooves 10510, 10520 are largely located at the first engagement body 1051 and the second engagement body 1052, respectively, by facing the accommodation base 105 in a longitudinal wise. The locating plate 106*a* has thereon a bottom rib 1063*a* and two lateral ribs 1062*a* located at respective places corresponding to the bottom groove 1053 and the two lateral grooves 10510, 10520, respectively. By engaging (inserting, in this embodiment) the bottom rib 1063*a* and the two lateral ribs 1062*a* of the locating plate 106*a* with the corresponding bottom groove 1053 and the two corresponding lateral grooves 10510, 10520, the locating plate 106*a* can then be positioned on the accommodation base 105 of the body 10. Then, the locating plate 106*a* can be fixed on the body 10 via screwing, gluing, soldering or the like.

The positioning block 107 can be assembled to the fitting structure 1061*a* of the locating plate 106*a* in a slidable manner. Thereupon, the positioning block 107 can be then confined and thus guided by the fitting structure 1061*a* to perform displacements in the first direction, so that the location of the positioning block 107 on the locating plate 106*a* in the first direction can be adjusted. The first fitting element 1071 is used to lock the positioning block 107 onto the locating plate 106*a*. After the positioning block 107 on the fitting structure 1061*a* of the locating plate 106*a* is displaced in the first direction to reach a predetermined position, the positioning block 107 can be positioned at the predetermined position on the locating plate 106*a* by the first fitting element 1071. Also, when the positioning block 107 is fixed on the locating plate 106*a*, a top portion 1072 of the positioning block 107 would protrude over the first engagement body 1051 and the second engagement body 1052 of the body 10. In this embodiment, the two opposing fitting structures 1061*a* are individually constructed to two opposing lateral sides of the locating plate 106*a*, and formed as narrow grooves extending in the first direction. In the second direction, the positioning block 107 has two opposing ends individually bent downward to form respective hook structures 1073 for hooking the corresponding fitting structures 1061*a* (the narrow grooves) at the two opposing lateral sides of the locating plate 106*a*, such that the positioning block 107 can be guided by, thus slide along, the fitting structures 1061*a* of the locating plate 106*a* to the predetermined position in the first direction.

The adjustable positioning assembly 108*a* includes a first clamp block 1081*a*, a second clamp block 1082*a*, and at least one second fitting element 1083*a* extending longitudinally in the second direction. The first clamp block 1081*a* and the second clamp block 1082*a* are individually to mount onto opposing ends of the at least one second fitting element 1083*a* by sleeving, and form substantially parallel to each other by an adjustable spacing. Namely, in the second direction, the spacing between the first clamp block 1081*a* and the second clamp block 1082*a* can be changed by adjusting the at least one second fitting element 1083*a*. In this embodiment, each of the first clamp block 1081*a* and the second clamp block 1082*a* includes a first gripping jaw (10811*a* and 10821*a*), a second gripping jaw (10812*a* and 10822*a*) and at least one bolt hole (10813*a* and 10823*a*). The first gripping jaws 10811*a*, 10821*a* of the first clamp block 1081*a* and the second clamp block 1082*a*, respectively, are used to clamp corresponding lateral recesses 10511, 10521 exterior to the first engagement body 1051 and the second engagement body 1052, respectively. In addition, the second gripping jaws 10812*a*, 10822*a* of the first clamp block 1081*a* and the second clamp block 1082*a* are used together to clamp the guide rail structure 91 of the carrier 9.

As shown in FIG. 10, the at least one second fitting element 1083*a* is used to adjust the spacing between the first clamp block 1081*a* and the second clamp block 1082*a* in the second direction, and thereby the body 10 can be clamped through the adjustable positioning assembly 108*a* to engage the guide rail structure 91 of the carrier 9, such that no more displacement of the body 10 with respect to the carrier 9 in the second direction can be possible. Under this circumstance, even in the case that a width of the guide rail structure 91 of the carrier 9 is slightly biased, proper clamping can be still achieved through adjusting the spacing of the first clamp block 1081*a* and the second clamp block 1082*a* in the second direction. In other words, the adjustable positioning assembly 108*a* provided by the present invention can clamp the body 10 onto a gun carrier 9 with an arbitrary width. In this embodiment, the second fitting element 1083*a*, structured to be a screw bolt, is to connect spatially the first clamp block 1081*a* and the second clamp block 1082*a* by penetrating corresponding bolt holes 10813*a*. 10823*a* thereof, respectively.

As shown in FIG. 11B, when the body 10 is clamped, by the adjustable positioning assembly 108*a*, to engage the guide rail structure 91 of the carrier 9, the top portion 1072 of the positioning block 107 would be inserted into a transverse positioning groove 911 of the guide rail structure 91 of the carrier 9, such that no movement of the body 10 in the first direction with respect to the carrier 9 can be performed. In addition, a tail end of the body 10 in the first direction has a rear concavity 109. When the body 10 is clamped to engage the guide rail structure 91 of the carrier 9 through the adjustable positioning assembly 108*a*, a trigger guard 93 of the gun (carrier 9) would be right fitted into the rear concavity 109.

As shown in FIG. 7 and FIG. 8, in this embodiment, a V-shape groove 10601*a* extending in the first direction is constructed on an upper surface 1060*a* of the locating plate 106*a*. The first fitting element 1071, formed as a screw, is firstly screwed through a screw hole of the positioning block 107, and then penetrates further to have a lower end thereof to contact at both slant sidewalls of the V-shape groove 10601*a*. In this state, since both hook structures 1073 formed as opposing ends of the positioning block 107 are individually connected with the corresponding fitting structures 1061*a* of the locating plate 106*a* by hooking, so the positioning block 107 can be locked to the locating plate 106*a*. In other words, when the laser target pointer 1*a* of this embodiment is clamped to engage the guide rail structure 91 of the carrier 9, the positioning block 107 would be right fitted in the transverse positioning groove 911, such that any position shift of the body 10 in the first direction can be avoided.

That is to say a major difference between the laser target pointer 1*a* of this embodiment and that laser target pointer 1 of FIG. 1 is that the locating plate 106*a* of the laser target pointer 1*a* is located in the accommodation base 105 (i.e., between the first engagement body 1051 and the second engagement body 1052), and also a slip trace of the positioning block 107 engaged with the locating plate 106*a* in the first direction is confined by the second fitting elements 1083*a* (screw bolts) of the adjustable positioning assembly 108*a*. In other words, the locating plate 106*a* is fixed on the body 10 so as to limit the movement of the positioning block 107 in the first direction within the two second fitting elements 1083*a* (screw bolts). Namely, the two second fitting elements 1083*a* (screw bolts) located exteriorly to the two end surfaces of the locating plate 106*a* in the first direction can form stops to front and rear opens ends of the fitting structure 1061*a* (narrow groove), such that the positioning block 107 can be only positioned on the fitting structure 1061*a* (narrow groove) at a location between the two second fitting elements 1083*a* (screw bolts).

Further, another difference between the laser target pointer 1*a* of this embodiment and that laser target pointer 1 of FIG. 1 is that each of exterior lateral sides of the first clamp block 1081*a* and the second clamp block 1082*a* of the adjustable positioning assembly 108*a* is formed largely as a long-side quadrilateral broader (especially in length) than that shown in FIG. 1. Thereupon, in this embodiment, the spacing provided by the at least two second fitting elements 1083*a* (screw bolts) can be prolonged. Also, lengths of the first gripping jaws 10811*a*. 10821*a* and the second gripping jaws 10812*a*, 10822*a* can be longer. Thereby, the contact area between the guide rail structure 91 of the gun (carrier 9) and each of the lateral recesses 10511, 10521 of the body 10 can be increased; such that, thanks to the enhancement of the clamping forcing provided by the adjustable positioning assembly 108*a*, the engagement of the body 10 onto the gun 9 can be better assured.

Furthermore, a third difference between the laser target pointer 1*a* of this embodiment and that laser target pointer 1 of FIG. 1 is that, in this embodiment, except that the second fitting element 1083*a* (screw bolt) adopts a unique-piece metal screw bolt, all other connection elements (such as housing of the body 10, the locating plate 106*a*, the first clamp block 1081*a* and the second clamp block 1082*a* of the adjustable positioning assembly 108*a*) are made of plastic materials, such as plastic steel or other industrial hard plastics. Thus, the total weight of the laser target pointer can be further reduced, without trading off the rigidity. Also, the laser target pointer of this embodiment can be featured in light weight, high toughness, anti-corrosion, well electric insulation, slow heat conduction and good heat resistance.

Please refer to FIGS. 9A, 9C and 9E. In a preferred embodiment of the present invention, two display windows 1005 are respectively located at the left and right sides of the rear surface of laser target pointer 1*a*. Several marks 10051, 10052,10053 (such like a thunder-mark 10051, laser-pointer-mark 10052 and battery-mark 10053) are shown in each display window 1005, in which, each mark 10051, 10052,10053 is equipped with a small light source such as LED in order to make it lit. The thunder-mark 10051 refers to the operating conditions of the light-source module 102, and the laser-pointer-mark 10052 refers to the operating conditions of the laser module 101, while the battery-mark 10053 refers to the remaining power amount of the battery of the power module 103. Two buttons 1006 and 1007 are furnished at the bottom surface of the laser target pointer 1*a*, wherein, one button 1006 is marked with a thunder-mark, while another button 1007 is marked with a laser-pointer-mark. In addition, each of the slip proof structures 104 are also respectively furnished with a switching button therein. When the switch module 1001 is switched to "power OFF" condition, no electricity will be provided by the battery of power module 103 to neither the laser module 101, the light-source module 102 nor the display windows 1005. Under such "power OFF" condition, no function will be activated by pressing the buttons 1006, 1007. When the switch module 1001 is switched to "power ON" condition, user can activate different functions of the laser target pointer 1*a* by pressing the buttons 1006, 1007. For example, when the user presses the button 1006 one time, then the light-source module 102 will be switched to "continuous mode", and then, if the button 1006 is pressed once again (the second time), then the light-source module 102 will be switched to "flashing mode", and then, if the button 1006 is pressed once again (the third time), then the light-source module 102 will be switched to "OFF mode", and then, if the button 1006 is pressed once again (the fourth time), then the light-source module 102 will be switched to "continuous mode" again, and etc. When the switch module 1001 is switched to "power ON" condition, and the button 1006 is pressed in order to activate the "continuous mode", the light-source module 102 will light (shine) continuously when the user also presses the slip proof structures 104; in the meantime, the thunder-mark 10051 will also light constantly to represent the "continuous mode" function of the light-source module 102. When the switch module 1001 is switched to "power ON" condition, and the button 1006 is pressed in order to activate the "flashing mode", the light-source module 102 will flash (rapidly and repeatedly switching on and off the light-source module 102) when the user also presses the slip proof structures 104; in the meantime, the thunder-mark 10051 will also flash to represent the "flashing mode" function of the light-source module 102. When the button 1006 is pressed in order to activate the "OFF mode", the thunder-mark 10051 is dark, and the light-source module 102 will not light no matter if the slip proof structures 104 is pressed or not.

In this embodiment, when the user presses the button 1007 one time, then the laser module 101 will be switched to "continuous mode", and then, if the button 1007 is pressed once again (the second time), then the laser module 101 will be switched to "flashing mode", and then, if the button 1007 is pressed once again (the third time), then the laser module 101 will be switched to "OFF mode", and then, if the button 1007 is pressed once again (the fourth time), then the laser module 101 will be switched to "continuous mode" again, and etc. When the switch module 1001 is switched to "power ON" condition, and the button 1007 is pressed in order to activate the "continuous mode", the laser module 101 will light (shine) continuously when the user also presses the slip proof structures 104; in the meantime, the laser-pointer-mark 10052 will also light constantly to represent the "continuous mode" function of the laser module 101. When the switch module 1001 is switched to "power ON" condition, and the button 1007 is pressed in order to activate the "flashing mode", the laser module 101 will flash (rapidly and repeatedly switching on and off the laser module 101) when the user also presses the slip proof structures 104; in the meantime, the laser-pointer-mark 10052 will also flash to represent the "flashing mode" function of the laser module 101. When the button 1007 is pressed in order to activate the "OFF mode", the laser-pointer-mark 10052 is dark, and the laser module 101 will not light no matter if the slip proof structures 104 is pressed or not. If the slip proof structures 104 are not pressed, neither the laser module 101 nor the light-source module 102 will be lit no matter what functions thereof are activated.

In summary, the laser target pointer 1 provided by this invention can clamp the body 10 of the laser target pointer 1 firmly on the gun carrier 9 of the gun with an arbitrary width by adjusting the relative spacing between the two clamp blocks 1081, 1082 of the adjustable positioning assembly 108 in the second direction, and can also position the body 10 of the laser target pointer 1 onto the gun carrier 9 having any transverse positioning groove 911 by adjusting the position of the positioning block 107 with respect to the locating plate 106 in the first direction. Thus, by providing the innovative assembly structure of the present invention to include the two engagement bodies 1051, 1052, the locating plate 106, the positioning block 107 and the adjustable positioning assembly 108 on the top portion of the body 10, the laser target pointer 1 can be properly assembled to any gun carrier 9 with a gun body having specifications (especially, the width of the gun body) within a predetermined range, and can adjust the position of the laser target pointer on the gun body in the extension direction (i.e., the first direction), such that a single laser target pointer of this present invention can be applicable to various guns with different brands, types, series or specifications.

While the present invention has been particularly shown and described with reference to a preferred embodiment, it will be understood by those skilled in the art that various changes in form and detail may be without departing from the spirit and scope of the present invention.

What is claimed is:

1. A laser target pointer, to be engaged with a carrier having a guide rail structure extending in a first direction, comprising:

a body, including thereon a laser module and a power module, having a top surface furnished with an accommodation base, a first engagement body and a second engagement body, wherein the first engagement body and the second engagement body are located individually to two opposing lateral sides of the accommodation base and extend in the first direction;

a locating plate, located in the accommodation base, integrated with the body as a unique piece, having thereon a fitting structure between the first engagement body and the second engagement body, the fitting structure extending in the first direction;

a positioning block, assembled to the fitting structure of the locating plate in a slidable manner so as to be confined and thus guided by the fitting structure to perform displacements in the first direction, so that a location of the positioning block on the locating plate in the first direction is adjustable;

a first fitting element, being to lock the positioning block onto the locating plate; wherein, after the positioning block on the fitting structure of the locating plate is displaced in the first direction to reach a predetermined position, the positioning block is positioned at the predetermined position on the locating plate by the first fitting element; wherein, when the positioning block is fixed on the locating plate, a top portion of the positioning block protrudes over the first engagement body and the second engagement body of the body; and an adjustable positioning assembly, including a first clamp block, a second clamp block and at least one second fitting element extending in a second direction perpendicular to the first direction, the first clamp block and the second clamp block being individually to mount onto the at least one second fitting element by sleeving, the at least one second fitting element being used to adjust spacing between the first clamp block and the second clamp block in the second direction;

wherein each of the first clamp block and the second clamp block includes a first gripping jaw and a second gripping jaw, the first gripping jaws of the first clamp block and the second clamp block are used to clamp the first engagement body and the second engagement body, respectively, the second gripping jaws of the first clamp block and the second clamp block are used to clamp the guide rail structure of the carrier, the at least one second fitting element is used to adjust the spacing between the first clamp block and the second clamp block in the second direction, and thereby the body is clamped through the adjustable positioning assembly to engage the guide rail structure of the carrier, such that no more displacement of the body with respect to the carrier in the second direction is allowed;

wherein, when the body is clamped through the adjustable positioning assembly to engage the guide rail structure of the carrier, the top portion of the positioning block is inserted into the guide rail structure of the carrier, so that no more displacement of the body with respect to the carrier in the first direction is allowed.

2. The laser target pointer of claim 1, wherein a bottom groove and two lateral grooves are extended on the accommodation base in the first direction, the locating plate has thereon a bottom rib and two lateral ribs located at respective places corresponding to the bottom groove and the two lateral grooves, respectively; wherein, by engaging the bottom rib and the two lateral ribs of the locating plate with the corresponding bottom groove and the two corresponding lateral grooves, the locating plate is then positioned on the accommodation base.

3. The laser target pointer of claim 1, wherein the positioning block has two opposing ends individually bent downward to form respective hook structures for hooking the corresponding fitting structures at the two opposing lateral sides of the locating plate, such that the positioning block is guided by, thus slides along, the fitting structures of the locating plate to the predetermined position in the first direction.

4. The laser target pointer of claim 3, wherein a V-shape groove extending in the first direction and at least one top groove extending in the second direction are constructed on an upper surface of the locating plate, the first fitting element is a screw, and the screw is firstly screwed through a screw hole of the positioning block and then penetrates further to have a lower end thereof to insert and contact the V-shape groove so as to lock the positioning block on the locating plate; wherein, when the first gripping jaws of the first clamp block and the second clamp block of the adjustable positioning assembly are clamped with the corresponding first engagement body and second engagement body of the body, the at least one second fitting element is located in the at least one top groove of the locating plate.

5. The laser target pointer of claim 3, wherein the carrier is a gun, and a tail end of the body in the first direction has a rear concavity; wherein, when the body is clamped to engage the guide rail structure of the carrier through the adjustable positioning assembly, a trigger guard of the gun is right fitted into the rear concavity.

6. The laser target pointer of claim 1, wherein each of two end surfaces of the body in the second direction is furnished with a slip proof structure for user's fingers to touch thereon, and the body further includes thereon a light-source module, a switch module and at least two adjusting member, the switch module being electrically coupled with the laser module, the light-source module and the power module to control the power module in energizing the laser module and the light-source module, the at least two adjusting members being to adjust a light-emitting angle of a laser beam emitted by the laser module.

7. The laser target pointer of claim 1, wherein the locating plate is located in the accommodation base between the first engagement body and the second engagement body, a slip trace of the positioning block engaged with the locating plate in the first direction is confined by the second fitting elements of the adjustable positioning assembly, and the two second fitting elements are located exteriorly to two end surfaces of the locating plate in the first direction.

8. The laser target pointer of claim 1, wherein each of exterior lateral sides of the first clamp block and the second clamp block of the adjustable positioning assembly is formed largely as a long-side quadrilateral.

9. The laser target pointer of claim 1, wherein the second fitting element adopts a unique-piece metal screw bolt, and all of a housing of the body, the locating plate, the first clamp block and the second clamp block of the adjustable positioning assembly are made of plastic materials.

10. The laser target pointer of claim 6, wherein:

at least one display window is located at a rear surface of the laser target pointer; at least a first mark and a second mark are shown in the display window, in which, each mark is equipped with a small light source in order to make it lit; the first mark refers to operating conditions of the light-source module, and the second mark refers to operating conditions of the laser module;

the operating conditions of the light-source module and the laser module both comprises a "continuous mode", a "flashing mode" and a "OFF mode";

at least a first button and a second button are furnished at the laser target pointer, in addition, the slip proof structure is furnished with a switching button therein; the operating conditions of the light-source module can be switched between the "continuous mode", the "flashing mode" and the "OFF mode" by pressing the first button; the operating conditions of the laser module can be switched between the "continuous mode", the "flashing mode" and the "OFF mode" by pressing the second button; the laser module and the light-source module will light only when the slip proof structure is pressed.

* * * * *